US006280350B1

(12) United States Patent
Chung

(10) Patent No.: US 6,280,350 B1
(45) Date of Patent: Aug. 28, 2001

(54) GOLF TEE

(75) Inventor: Hyun Soo Chung, Seoul (KR)

(73) Assignee: IRE Chemical Ltd., Seoul (KR)

( * ) Notice: Subject to any disclaimer, the term of this patent is extended or adjusted under 35 U.S.C. 154(b) by 0 days.

(21) Appl. No.: 09/606,003

(22) Filed: Jun. 29, 2000

(30) Foreign Application Priority Data

Jul. 13, 1999 (KR) ..... 99-13767

(51) Int. Cl.[7] ..... A63B 57/00
(52) U.S. Cl. ..... 473/387
(58) Field of Search ..... 473/387, 388, 473/389, 390–403; 273/201–212

(56) References Cited

U.S. PATENT DOCUMENTS

D. 393,301 * 4/1998 Koskela ..... D21/208
4,787,637 * 11/1988 Lima et al. ..... 273/212
4,951,945 * 8/1990 Gamble ..... 273/33
5,413,330 * 5/1995 Disco et al. ..... 473/387
6,062,990 * 5/2000 Pierce ..... 473/387
6,139,449 * 10/2000 Cardarelli ..... 473/387

* cited by examiner

*Primary Examiner*—Steven Wong
(74) *Attorney, Agent, or Firm*—Birch, Stewart, Kolasch & Birch, LLP

(57) ABSTRACT

A golf tee on which a golf ball is positioned. The golf tee 100 has a head 125 having a golf ball positioning portion 115. A shaft 135 is connected to the head. The shaft 135 is tapered from the head 125 towards one end thereof and has a quadrangular cross-section. A recessed portion 130 is formed in the golf ball positioning portion 115 of the head portion. The central line 150 of the recessed portion is substantially identical with the central line of the quadrangular surface of the shaft.

3 Claims, 2 Drawing Sheets

GOLF TEE

BACKGROUND OF THE INVENTION

1. Field of the Invention

The present invention relates to a golf tee on which a golf ball is positioned.

2. Description of the Prior Art

As shown in FIG. 1, the conventional golf tee 10 comprises a head 25 having a golf ball positioning portion on which a golf ball is positioned and a shaft 35. The shaft 35 is tapered from the head 25 towards one end thereof. The golf ball positioning portion is convex towards the shaft, and supports the golf ball when the golf ball 20 is positioned on the golf ball positioning portion 15.

However, since the above-mentioned golf tee 10 has a circular head 25, the contact area with the golf ball is large, and the indication direction of the golf ball cannot be known, and the direction of the golf ball can be changed due to the excessive friction of the head portion.

SUMMARY OF THE INVENTION

The present invention has been made to solve the above mentioned problem, and accordingly it is the object of the present invention to provide a golf tee in which an edge portion of a funnel-shaped golf tee head 25 is cut-off to have an elliptical shape and one side is recessed.

By the above-mentioned head portion of the golf tee, the friction with the golf tee is reduced, the golf tee has an indication portion by which the striking direction of the golf ball is indicated.

In a golf tee which has a funnel-shaped golf ball positioning portion on the upper surface of a head portion and a shaft connected to the head portion, the shaft being tapered from the head portion towards one end thereof, at least one recessed portion is formed in the peripheral portion of the golf ball positioning portion of the head portion.

The shaft has a quadrangular cross-section, and the central line of the quadrangular surface plane and the central line of the recessed portion is identical axially aligned.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Hereinafter, the structure and the operation of a golf tee 100 according to the present invention will be explained with reference to FIGS. 2 to 4.

Figure 1:
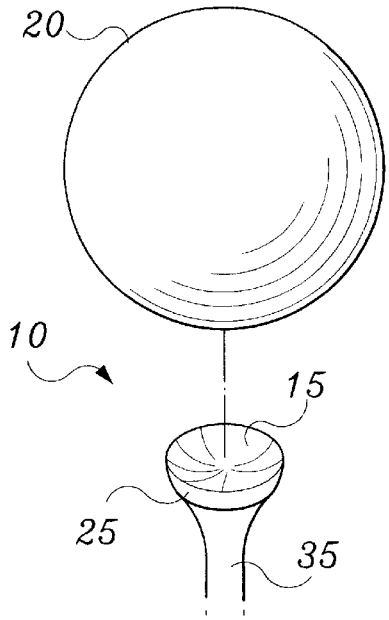
FIG. 1 is a perspective view for showing a conventional golf tee.
Figure 2:
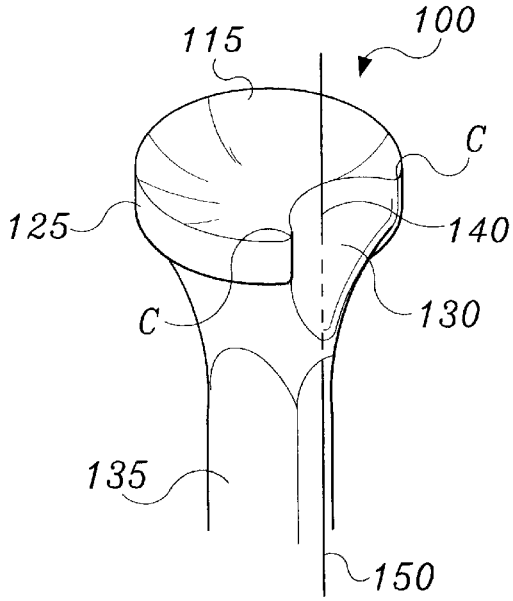
FIG. 2 is a perspective view for showing a golf tee according to the present invention.
Figure 3:
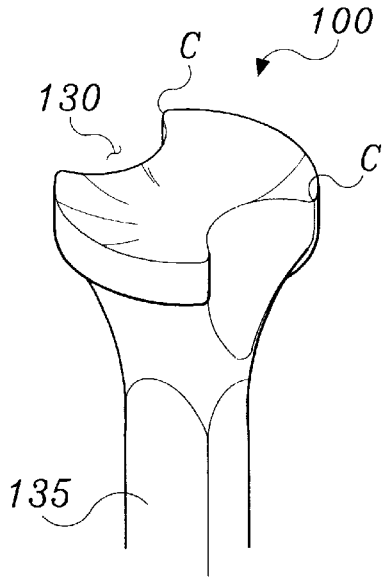
FIG. 3 is a perspective view for showing another golf tee according to the present invention.

As shown in FIGS. 2 and 3, a head 125 having a golf ball positioning portion 115 on which a golf ball is positioned is formed, and a shaft 135 is connected to the head. The shaft 135 is tapered from the head 125 towards one end thereof, and has a quadrangular cross-section. Furthermore, at least one recessed portion 130 is formed in the head portion. The recessed portion 130 is formed by recessing a portion of the golf ball positioning portion 115. The first central line 140 of the recessed portion is axially aligned with the second central line 150 of the quadrangular surface of the shaft. The first central line 140 of the recess portion 130 is located at the apex of the recessed portion. The C-shaped of the recessed portion has an arc-shape to reduce the friction with the golf ball, and the recessed portion is used to indicate the striking direction of the golf ball.

Firstly, the golf ball 120 is positioned on the golf ball positioning portion 115, and the shaft 135 is inserted between the fingers, and then the golf pin is inserted into the ground. Since the golf tee is not rotated arbitrarily due to the quadrangular cross-section of the shaft, the direction of the recessed portion 130 is accurately controlled.

Figure 4:
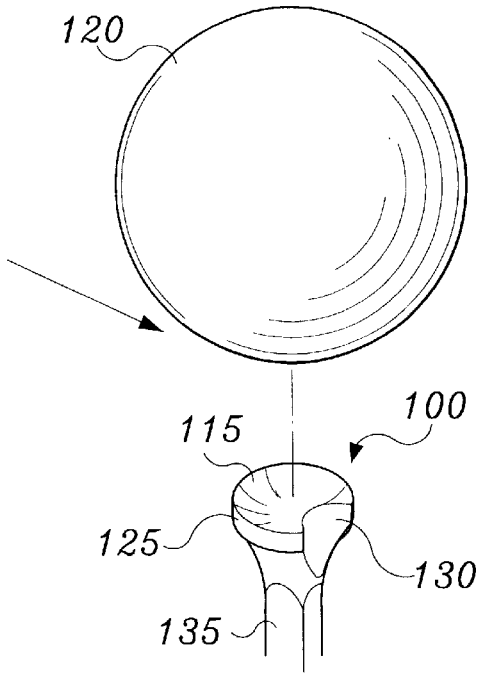
FIG. 4 is a view for explaining the using method of the golf tee according to the present invention.

If the golf ball is tee-shot from the direction of the arrow of FIG. 4, the golf ball is rotated reversely and is flown towards the recessed portion.

As above-described, since by forming a recessed portion in the head portion of the golf tee, the surface of the head 125 which makes contact with the golf ball 120 is reduced, the friction of the golf ball is reduced, and the striking direction of the golf ball is accurately controlled.

As stated above, preferred embodiments of the present invention are shown and described. Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A golf tee comprising:

a funnel-shaped golf ball positioning portion on an upper surface of a head portion;

at least one recessed portion formed in a peripheral portion of the golf ball positioning portion of the head, the recessed portion having a first central line; and a shaft connected to the head portion which is tapered from the head portion towards one end thereof, the shaft having a square cross-section and at least one surface plane of the square cross-section having a second central line axially aligned with the first central line of the recessed portion.

2. The golf tee according to claim 1, wherein the recessed portion further includes a C-shaped portion.

3. The golf tee according to claim 1, wherein the first central line intersects the apex of the recessed portion.

* * * * *